US006343954B1

(12) United States Patent
Facciano et al.

(10) Patent No.: US 6,343,954 B1
(45) Date of Patent: Feb. 5, 2002

(54) INTEGRAL MISSILE HARNESS-FAIRING ASSEMBLY

(75) Inventors: Andrew B. Facciano; Steve E. Taylor, both of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/593,204

(22) Filed: Jun. 14, 2000

(51) Int. Cl.[7] ..... H01R 13/58
(52) U.S. Cl. ..... 439/604; 439/606
(58) Field of Search ..... 439/604, 623, 439/502, 503, 505, 34, 247, 248, 130, 652, 214, 216, 606, 499

(56) References Cited

U.S. PATENT DOCUMENTS 3,836,415 A * 9/1974 Hilderbrandt ..... 156/296
4,649,228 A * 3/1987 Suzuki ..... 174/36
4,815,984 A * 3/1989 Sugiyama et al. ..... 439/211
4,824,164 A * 4/1989 Nakayama et al. ..... 296/146
5,030,116 A * 7/1991 Sakai et al. ..... 439/130
5,100,347 A * 3/1992 Malasky, III et al. ..... 439/604
5,252,091 A * 10/1993 Fujita et al. ..... 439/499
5,428,187 A * 6/1995 Crane et al. ..... 174/36
5,909,012 A * 6/1999 Todd et al. ..... 174/266
5,917,151 A * 6/1999 O'Brien ..... 174/72 A
6,000,959 A * 12/1999 Curtindale et al. ..... 439/247

* cited by examiner

*Primary Examiner*—P. Austin Bradley
*Assistant Examiner*—Ross Gushi
(74) *Attorney, Agent, or Firm*—Colin M. Raufer; William J. Benman, Jr.; Glenn H. Lenzen, Jr.

(57) ABSTRACT

The present invention relates to an improved electrical interconnection assembly adaptable for creating electrical connections between spaced-apart sections of a high performance missile assembly. Because the electrical connection must extend outside the missile, a plurality of electrical interconnections are integrally formed within a protective housing that is, itself of aerodynamic configuration. The cables may take the form of flat wires, or printed wire assemblies integral with the housing. Pre-stressed foam is formed in the housing to insulate the electrical interconnections. Wire mesh is preferably mounted in the housing between the interconnections and the outside of the housing to protect the interconnections from Electro-magnetic Interference (EMI).

14 Claims, 3 Drawing Sheets

FIG. 5a
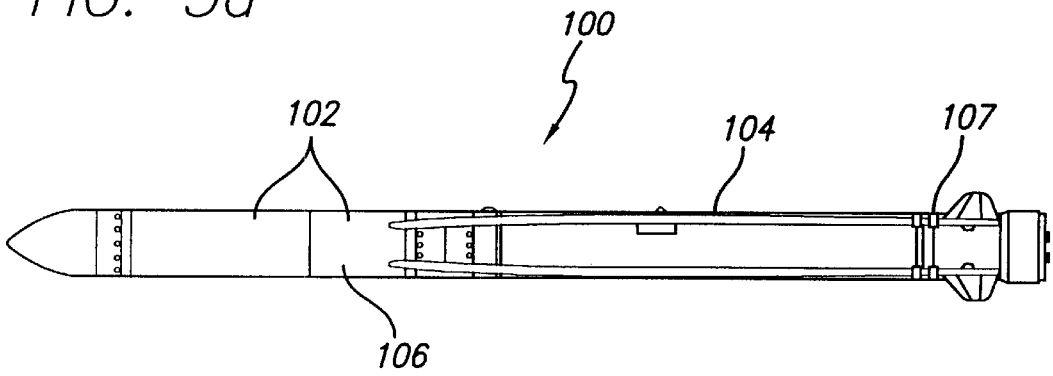
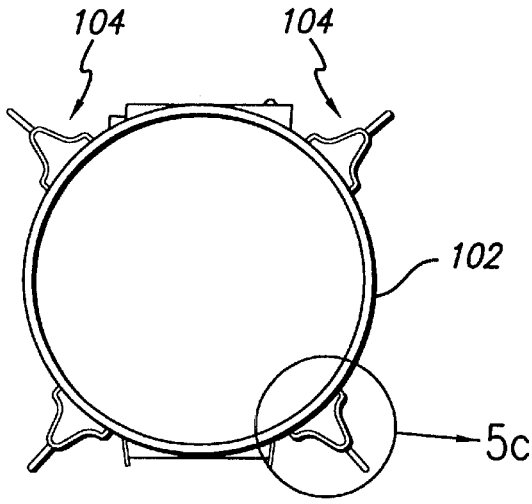
FIG. 5b
FIG. 5c
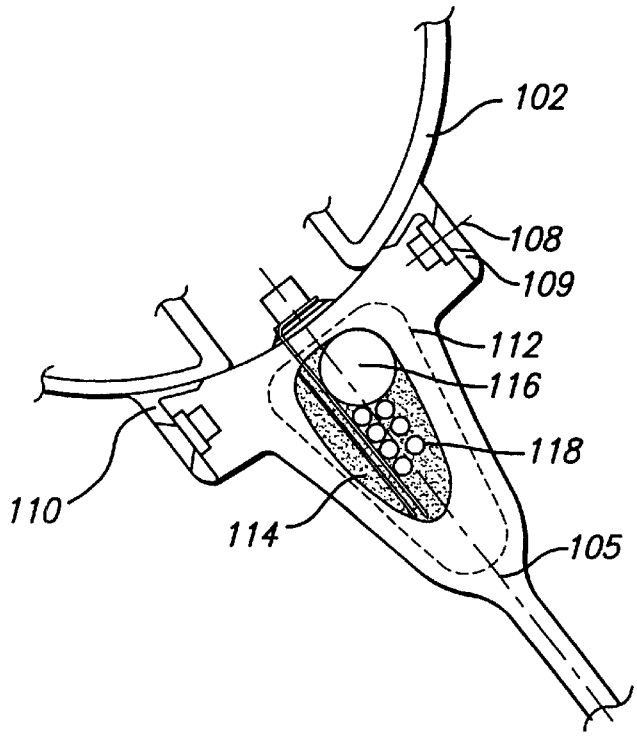

INTEGRAL MISSILE HARNESS-FAIRING ASSEMBLY

BACKGROUND OF THE INVENTION

1. Field of the Invention

The present invention relates to missiles. More specifically, the present invention relates to harness assemblies for electrically joining various sections of high performance missile systems.

2. Description of the Related Art

High performance missile assemblies generally include a plurality of different sections that, when secured end-to-end, form the missile fuselage. Normally, a guidance section is mounted forward of the propulsion and warhead sections with a control section mounted to the rear of the propulsion and warhead sections. In order to electrically interconnect the guidance and control sections, a conventional wire harness is employed. Because it is not possible to run such a harness internally through the propulsion and warhead sections of such a missile fuselage, the harness is mounted outside the missile adjacent the exterior surface. A conventional wire harness assembly is comprised of discrete electrical lines individually insulated from the external environment. In one such known assembly, the individual wires are assembled with plastic tie-wraps and are wire mesh overbraided for EMI protection. To provide additional protection against the environment, the harness wires may be positioned within a protective sleeve to insulate against severe aerodynamic exposure.

Each discrete electrical wire forming a conventional harness is individually connected at opposite ends to a receptacle extending from one of spaced-apart missile sections and then potted with silicon to seal the connection against environmental penetration and degradation. During final assembly, the electrical harness is secured to the missile airframe by metal clamps and adapters. A harness cover is then mounted over the electrical harness and secured to the missile fuselage with attachment fasteners. The electrical harness cover serves to protect the harness wires while providing the missile with aerodynamic form factoring, aeroheating and impact load insulation. If necessary, the harness cover may also provide additional EMI protection.

In any event, the process of connecting each wire to its receptacle and then mounting the cover over the harness has been found to be labor intensive, prone to human assembly error and susceptible to handling damage.

Hence, a need exists in the art for an improved electrical interconnection assembly that functionally connects various missile sections to one another notwithstanding a location of certain sections on opposite sides of warhead and/or propulsion sections. The electrical interconnection assembly should utilize advanced manufacturing and assembly techniques. The interconnection assembly should be packaged to withstand and operate in the extremely adverse environments, both temperature and pressure, routinely encountered by the missile during flight to the target.

SUMMARY OF THE INVENTION

The present invention addresses the need in the art for an improved electrical interconnection between various sections forming a missile fuselage. The invention includes an electrical interconnection assembly integrally formed within and surrounded by a protective housing shaped as an aerodynamic fairing and adaptable for attachment to an exterior surface of the missile fuselage. The protective housing also includes pre-stressed structural foam surrounding the interconnection members for added insulation. The interconnection assembly and the surrounding protective housing are fabricated as a single, composite member. The electrical interconnection assembly is sealed from ambient atmospheric humidity, shielded from Electro-magnetic Interference (EMI) and insulated from aerothermal heating by the external housing which is formed as a laminate structure.

The electrical interconnection assembly may consist of a plurality of separate electrical connecting members, each embedded directly into the laminate before it is molded into the aerodynamically-shaped protective housing or fairing. This eliminates the need for conventional harness insulating techniques such as Teflon bagging, manual hardware mounting and cable strapping. Preferably, an embedded mesh screen is formed as the housing is created and functions to envelop the electrical interconnection members to provide additional EMI shielding while at the same time being grounded to fasteners retaining the housing in position against the outer surface of the missile. The pre-compressed structural foam surrounding the interconnection members serves to insulate the members from aerodynamic heating. The foam flows within the housing during cure so that the laminate can conform to the mold shape. The foam forms a lightweight sandwich core to enhance laminate stiffness and strength.

The protective housing or fairing may be formed of a resin material such as Cyanate Ester. Alternatively, the housing may be molded from fiber reinforced Bismaleimide (BMI) resins which, along with Cyanate Ester, are known for their high temperature airframe applications as well as their economical cost of production. BMI laminates have been tested for jet engine firewall applications at over 2000° F., and have been found to degrade in a predictable, graceful manner without catastrophic failure over a period of approximately fifteen (15) minutes. BMI is as processible as epoxy, has thermal capabilities approaching that of polyimides, yet has no carcinogenic downside. BMI enables utilization of automated fabrication techniques such as filament winding, compression molding and Resin Transfer Molding (RTM) in manufacturing complex composite housing assemblies in a cost effective manner.

Large combinations of electrical wires, cables, and bundles may compromise the integral housing assembly process, therefore designs utilizing higher density cabling should be attempted. Alternatively, printed wiring, ribbon cable, and/or polyurethane flex cables may serve as the electrical interconnection members. Once the composite interconnection assembly and protective housing is positioned adjacent the outer surface of the missile, fixed or floating connectors extending from receptacles mounted on the various sections of the missile could plug into connectors integrally formed with the housing, thereby eliminating the need for silicon potting.

A primary goal of the present invention is to be able to produce generic airframe electrical interconnections that are applicable to multiple missile production lines, at a significantly reduced cost compared to existing interconnection assemblies. The aerodynamically-shaped housing may take any desired shape, for example, a fin attachment member or an elongated, beam shaped fairing. In any case, the composite housing will consist of a Glass/BMI laminate containing either pre-compressed structural or high temperature syntatic foam, copper EMI mesh, Kapton and/or polyurethane flex cables sandwiched with a molded in-place electrical connector adaptable for connection to various sections of the missile.

BRIEF DESCRIPTION OF THE DRAWINGS

The various advantages of the present invention will become apparent to one skilled in the art by reading the following specification and by reference to the following drawings in which:

FIGS. 5*a*, 5*b* and 5*c* are side, cross section and perspective views, respectively, of an electrical harness assembly formed in accordance with the present invention.

DETAILED DESCRIPTION OF THE INVENTION

Illustrative embodiments and exemplary applications are described below with reference to the accompanying drawings in order to disclose the advantageous teachings of the present invention.

Figure 1:
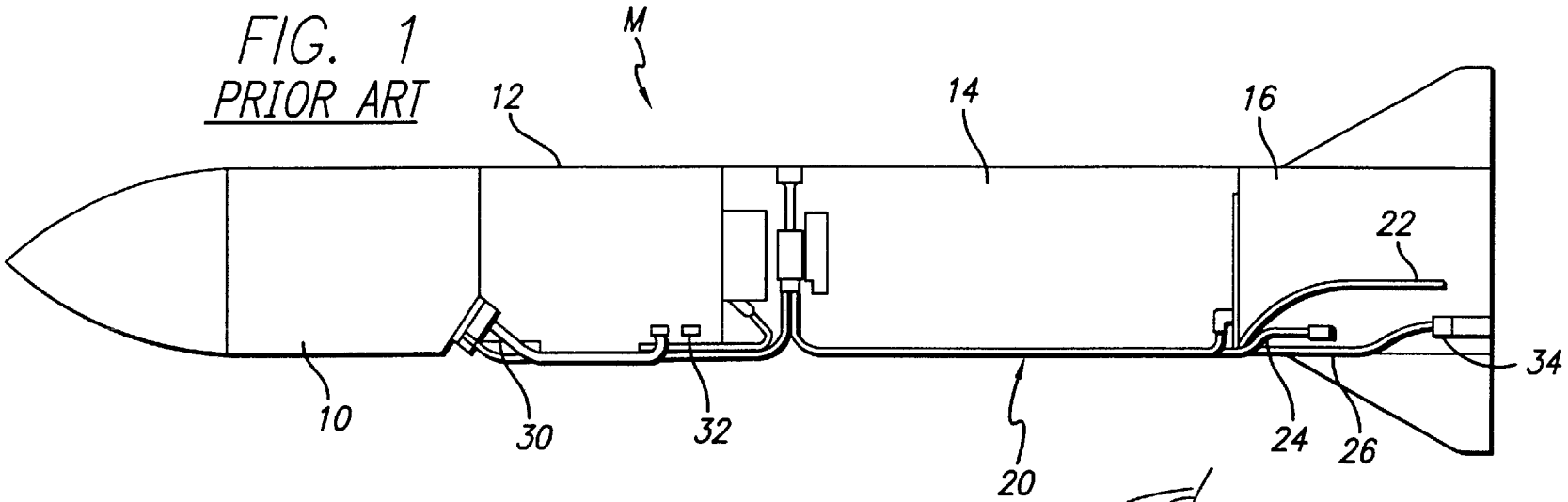
FIG. 1 PRIOR ART
FIG. 1 is a side view of a prior art electrical harness assembly positioned adjacent a missile assembly with the harness cover removed.

Referring now to the drawings wherein like reference numerals designate like elements throughout, FIG. 1 shows a conventional high performance missile assembly M consisting of a number of discrete sections mounted end-to-end to form the missile fuselage. Moving in the aft direction along the fuselage of missile M are seen a guidance section 10, a warhead replaceable telemetry section 12, a propulsion section 14 and a control section 16. On a flight test missile, the warhead telemetry section 12 replaces the actual warhead. During test flight of missile M to its target, guidance section 10 must maintain electrical interconnection with both warhead telemetry section 12 and control section 16. However, in an real missile, the presence of propulsion section 14 and the actual warhead, not shown, in place of warhead telemetry section 12 makes it impossible to run electrical connectors internally between guidance section 10 and control section 16.

In the prior art assembly of FIG. 1, a bundle of separate wires forms a conventional wire harness 20 that is positioned outside the missile and runs lengthwise adjacent the various sections. This bundle or harness 20 usually comprises a plurality of separate wires such as wires 22, 24 and 26. Each of these wires serves as a connector and is individually insulated from the external environment. The wires 22, 24 and 26 are assembled with plastic tie-wraps into the desired shape of harness assembly 20. To protect against EMI exposure, a wire mesh may be overbraided. The harness 20 is usually placed within a protective sleeve for insulation against severe aerodynamic exposure.

As shown in FIG. 1, each wire 22, 24 and 26 is individually soldered to its respective connector receptacle 30, 32 and 34. The connections need to be potted with silicon or the like to seal the connections against environmental penetration and degradation.

Figure 2:
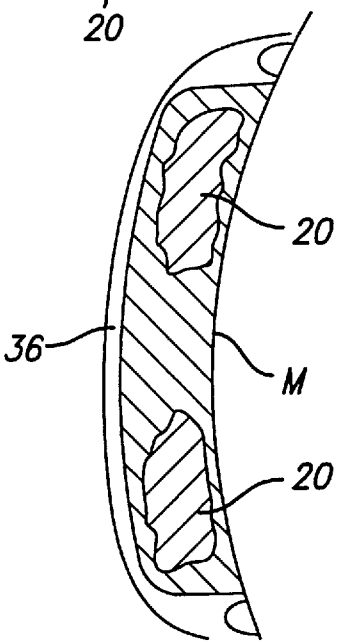
FIG. 2 PRIOR ART
FIG. 2 is a cross-sectional view of the prior art harness assembly according to FIG. 1 including the harness cover.

Turning to FIG. 2, the conventional wire harness 20 is shown as consisting of two separate groups of interconnectors each enclosed within an aerodynamic harness cover member 36. Cover 36, in turn, is attached to the exterior surface of missile M by means of conventional clamps, not shown. A conventional harness cover 36 would be created to withstand both heat and pressure.

Positioning and attaching each of the individual wires 22, 24, 26 in the prior art assembly followed by assembling and securing harness cover 36 is labor intensive, which makes it subject to human assembly error and can be easily damaged in handling. Because of size and shape differences between various missile assemblies, the harness and cover must be individually shaped and mounted for each missile. This makes the manufacturing process costly and adds to the difficulty of creating generic interconnection assemblies. While conventional harness assemblies are insulated, they may not be able to withstand maximum temperature spikes that can reach 1000° F. during a twenty second flight. Likewise, the harness and cover must be able to contend with airframe buffet loads resulting from 60G maneuvers and booster launch scenarios.

As will become clear, the present invention provides a unique, composite assembly including an electrical interconnection assembly integrally formed with a protective housing which is capable of operating in the most hostile environments encountered by a high performance missile and is constructed using economical procedures that minimize human contact.

Figure 3:
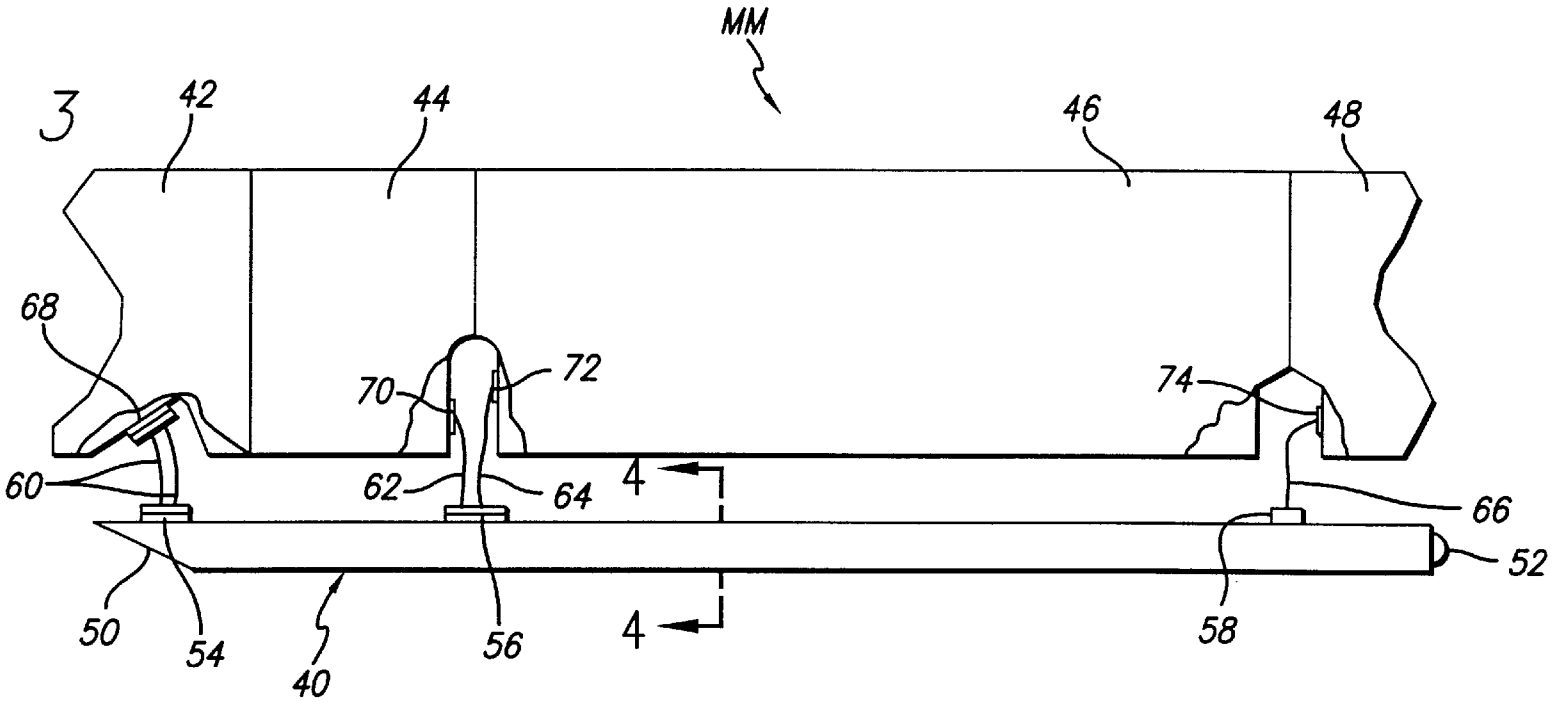
FIG. 3 is a side view of an integral, composite electrical interconnection and protective housing assembly formed in accordance with the present invention and spaced adjacent the exterior surface of a missile fuselage.

Referring now to FIG. 3, the integral electrical interconnection and protective housing assembly 40 takes the form of an aerodynamic beam structure extending lengthwise adjacent to a high performance missile MM. Missile MM includes a guidance section 42, followed by a warhead 44, a propulsion section 46 and a control section 48 mounted end-to-end. Protective housing assembly 40 has a faired leading edge 50 and may have a datalink antenna 52 mounted on the aft end. A number of electrical receptacles 54, 56 and 58 having guide pins or similar connectors are mounted on an interior surface of protective housing 40 facing the fuselage of missile MM. Connectors 60, 62, 64 and 66 may extend from the housing receptacles 54, 56, 58 into electrical connection with receptacles 68, 70, 72 and 74 mounted on one or more of the missile sections. This arrangement allows for misalignment between housing 40 and the fuselage of missile MM while still allowing for the required electrical interconnection between the various missile sections through housing 40.

Figure 4:
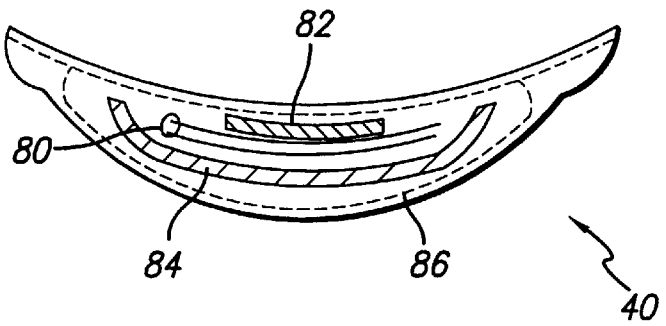
FIG. 4 is a cross-sectional view of the electrical interconnection and integral housing assembly formed in accordance with the present invention taken along the section line A—A in FIG. 1.

Protective housing assembly 40, as better shown in FIG. 4, is formed of either Glass/Cyanate Ester or a Glass/BMI laminate sandwich structure 76. The laminate is introduced into a mold of requisite size and shape for the aerodynamic fairing and cured in a conventional manner. The laminates have been tested for jet engine firewall applications at over 2000° F., and have been found to degrade in a predictable, graceful manner without catastrophic failure over a period of approximately fifteen (15) minutes. Either Cyanate Ester or BMI is as processible as epoxy, has thermal capabilities approaching that of polyimides, yet has no carcinogenic downside. This enables utilization of automated fabrication techniques such as filament winding, compression molding and Resin Transfer Molding (RTM) in manufacturing complex shaped protective housing assemblies 40 in a cost effective manner.

A novel aspect of the present invention resides in the manufacturing step of impregnating glass or silica microballoons into the outer Glass/BMI layer to significantly increase thermal insulation while reducing the mechanical properties of the laminate used in forming protective housing assembly 48. Ablative cooling also may be incorporated into housing assembly 40 by sizing the external Glass/BMI surface to shed a ply after a specified flight time has occurred.

A unique advantage of the electrical interconnection members and protective housing assembly 40 resides in the fact that composite housing 40 is fabricated as a single, integrated product.

After the laminate is introduced into the mold, Kapton flex cables identified at 80 in FIG. 4 are embedded between Glass/BMI prepreg. Polyurethane flat flexible cables 82 may also be introduced into the prepreg. Pre-compressed structural foam 84 is introduced to partially surround the cables 80 and 82 to provide thermal insulation from aerodynamic heating. Either high temperature syntatic foam or pre-stressed foam flows as the laminate cures allowing laminate 76 to conform to the dimensions of the housing mold. It is considered an aspect of the present invention as to whether the syntatic or pre-stressed foam 84 is added during the initial laminate formation process or is secondarily applied, thereby utilizing the existing housing as the bottom surface of the mold. By embedding the Kapton cables 80 and/or Polyurethane cables 82 directly into the fairing laminate, an environmental seal is created, obviating the need for conventional harness insulating techniques such as Teflon bagging, manual hardware mounting and cable strapping Whether Kapton flex cables 80, polyurethane flat flexible cables 82, individual wires or any known electrical connector is immersed into the laminate to form an integral, composite housing is considered within the scope of the present invention.

As further shown in FIG. 4, an embedded wire mesh screen 86, preferably formed of copper, is positioned between the outer surface of housing 40 and the various cables 80 and/or 82. Copper mesh screen 86 serves to provide EMI shielding while grounding the cables to fasteners, not shown, that attach housing 40 to the fuselage of missile MM.

The present invention eliminates the need for secondary processes by consolidation of common features, and integration of fabrication steps into a streamlined production. Product reliability and repeatability are significantly improved as compared to known procedures. As numerous components are integrated into the composite interconnection and housing assembly 40, fabrication processes and quality inspection steps previously done in parallel can be integrated into a single manufacturing process, wherein common requirements are performed only once. Features of an integral composite design are driven to be multifaceted, hence redundancy is reduced, if not eliminated. This causes the airframe performance to be enhanced and fabrication to be more economical. In a practice sense, elimination of processes and assembly layers by using simplified airframe components common to multiple missiles should minimize inspection and logistical requirements currently needed for multiple missile production programs. This should result in even more cost savings and schedule advantages when producing a multiplicity of different missiles.

Reference is made to an alternative embodiment of the present invention shown in FIGS. 5*a*, 5*b* and 5*c*, respectively. Air defense missiles 100 such as the Evolved SeaSparrow Missile (ESSM) have a relatively long chord 102, with short span dorsals or strakes 104 extending over the rocket motor in order to generate additional lift. Typically, four such dorsals or strakes 104, having aerofoil-shaped outer ends 105 are arranged in a cruciform layout as shown in FIG. 5*b*. One or more of the dorsals 104 could be used to house the AUR harness cables extending from the forward guidance section 106 of missile 100 to the missile's aft control section 107. In this embodiment, the dorsal aerofoil configuration is employed as a fairing cover similar to cover 36. Because a dorsal may carry significant aerodynamic loads, the attachment assembly must be able to capable of transmitting loads while remaining in tolerance alignment.

One such attachment assembly, shown in FIG. 5*c* may incorporate a floating insert or nutplate 108 and shell form factored into a mounting post capable of pinning dorsals 104 to the various sections making up missile chord 102. The floating inserts 108 are preferably inserted into tightly toleranced mounting holes 109 formed in pairs of spaced-apart welded tabs 110 facing each other every three to four inches along a substantial portion of the length of missile chord 102. When assembled, each of the floating nutplates 108 self-aligns and bears up against a weld tab 110, securing each dorsal 104 to missile chord 102 while, at the same time, allowing for bi-directional tolerance misalignment between dorsals 104 and missile chord 102.

As shown in FIG. 5*c*, a hollow dorsal 104 would include the embedded EMI shield 112 and a possible insulation barrier as with the previous embodiment. Flex cables 114 are embedded within the laminate shell structure of dorsal 104 along with wire/cable bundles 116. Molded insulation foam/filler 118 encapsulate flex cables 114. The flex cables 114 may be molded into the laminate structure of the protective cover. Alternatively, the flat flex cables 114 and rounded bundles of wire 116 may be placed into or onto a mold, then resin injected for integral formation of the electrical harness and dorsal assembly.

Thus, the present invention has been described with reference to a particular embodiment for a particular application. Those having ordinary skill in the art and access to the present teachings will recognize additional modifications, applications and embodiments within the scope thereof. Although the invention has been shown as being applicable to a high performance missile assembly, it is in no way limited to this application. For example, an integral electrical interconnection and housing assembly may be employed in the automotive industry in carrying signals from between sensors, processors and actuators. This application is believed to be timely considering the reduced space available in the engine and passenger compartments in today's vehicles. The same use of a composite interconnection and housing assembly is believed to be applicable to aviation and marine vehicles.

It is therefore intended by the appended claims to cover any and all such applications, modifications and embodiments within the scope of the present invention.

Accordingly,

What is claimed is:

1. An improved interconnection assembly for transmitting electrical signals between sections of a high performance missile assembly, comprising:

a protective housing having a predetermined aerodynamic configuration extending along and secured to an external surface of said missile assembly;

connection means extending within and integrally molded to said protective housing, said connection means including at least one connector adapted to effect an electrical connection through said protective housing; and a plurality of pairs of first and second receptacles engaging opposite ends of said connection means and electrically connected with further receptacles mounted on separate sections of said missile for electrically interconnecting said missile sections.

2. An improved interconnection assembly according to claim 1 wherein said interconnection assembly includes a plurality of flexible cables positioned within a protective sleeve.

3. An improved interconnection assembly according to claim 1, wherein pre-compressed structural foam is integrally molded with said resins to form said protective housing.

4. An improved interconnection assembly according to claim 1, wherein a wire mesh is inserted into said resins to form said protective housing.

5. An improved interconnection assembly according to claim 1, wherein said protective housing comprises fiber reinforced resins molded into a predetermined aerodynamic configuration.

6. An improved interconnection assembly according to claim 5, wherein said resins and at least one connector are integrally molded together to form said protective housing.

7. An improved interconnection assembly according to claim 1 wherein said interconnection assembly includes flat, flexible cables.

8. An improved interconnection assembly according to claim 7 wherein said flat, flexible cables are encapsulated with polyurethane.

9. An improved interconnection assembly for transmitting electrical signals between various sections of a missile assembly, comprising:

an elongated housing of predetermined aerodynamic configuration extending adjacent an outer surface of said missile assembly;

a plurality of pairs of first and second receptacles, each first receptacle being integrally formed with an outer surface portion of said housing and each second receptacle being integrally formed with a further outer surface portion of said housing, with each pair of receptacles facing the outer surface of said missile assembly;

a plurality of connectors, each connector forming an electrical interconnection between on of said receptacles integrally formed with said housing and a receptacle mounted on a section of said missile assembly; and connection means disposed within said housing for effecting an electrical connection between each pair of first and second receptacles formed with outer surface portions of said housing, thereby effecting an electrical connection through between various missile sections.

10. An improved interconnection assembly according to claim 9 wherein said connection means comprises a plurality of flexible cables positioned within a protective sleeve.

11. An improved interconnection assembly according to claim 9 wherein said housing comprises Cyanater Ester resins molded into a predetermined aerodynamic configuration.

12. An improved interconnection assembly according to claim 9 wherein said connection means comprises a plurality of flat, flexible cables extending between said pairs of receptacles.

13. An improved interconnection assembly according to claim 12 wherein said flat, flexible cables are encapsulated with polyurethane.

14. An improved interconnection assembly for transmitting electrical signals between receptacles mounted on spaced-apart sections of a high performance missile comprising:

a protective housing formed of fiber reinforced resins molded into an aerodynamic configuration;

a plurality of flat, flexible cable members molded into fixed position with said housing;

a plurality of pairs of first and second receptacles molded into different portions of an inner wall of said housing with a cable joining each pair of said first and second receptacles to form an electrical interconnection through said protective housing; and electrical connectors joining the receptacles mounted in the missile sections with the receptacles mounted on the protective housing to form an electrical connection between the missile sections.

* * * * *